US009612024B2

(12) United States Patent
Rohde

(10) Patent No.: US 9,612,024 B2
(45) Date of Patent: Apr. 4, 2017

(54) ENERGY EFFICIENT HVAC SYSTEM

(71) Applicant: Robert M. Rohde, Sandy, OR (US)

(72) Inventor: Robert M. Rohde, Sandy, OR (US)

( * ) Notice: Subject to any disclaimer, the term of this patent is extended or adjusted under 35 U.S.C. 154(b) by 0 days.

(21) Appl. No.: 14/804,159

(22) Filed: Jul. 20, 2015

(65) Prior Publication Data

US 2015/0323213 A1 Nov. 12, 2015

Related U.S. Application Data

(63) Continuation of application No. 14/069,147, filed on Oct. 31, 2013, now Pat. No. 9,121,620.

(51) Int. Cl.

| | |
|---|---|
| ***F24F 3/04*** | (2006.01) |
| ***F24F 3/052*** | (2006.01) |
| ***F24F 13/10*** | (2006.01) |
| ***F24F 11/00*** | (2006.01) |
| ***F24F 3/044*** | (2006.01) |
| ***F24F 7/08*** | (2006.01) |

(52) U.S. Cl.

CPC ..... *F24F 3/052* (2013.01); *F24F 3/044* (2013.01); *F24F 3/0527* (2013.01); *F24F 7/08* (2013.01); *F24F 11/0012* (2013.01); *F24F 13/10* (2013.01); *F24F 2011/0013* (2013.01)

(58) Field of Classification Search

CPC ..... F24F 3/052; F24F 2001/0066; F24F 2001/007; F24F 2001/0062; F24F 2003/006; F24F 3/0527; F24F 3/0525

USPC ..... 165/201, 244, 247, 248, 249, 252, 263, 165/264, 294, 296, 297, 298, 216, 212, 165/213, 217, 214, 205, 100, 101, 103

See application file for complete search history.

(56) References Cited

U.S. PATENT DOCUMENTS

| | | | | |
|---|---|---|---|---|
| 2,254,185 | A | 8/1941 | Newton | |
| 2,609,183 | A | 9/1952 | Fitzgerald | |
| 2,755,072 | A | 7/1956 | Kreuttner | |
| 2,793,812 | A | 5/1957 | McDonald | |
| 2,984,459 | A | 5/1961 | Waterfill | |
| 3,167,253 | A | 1/1965 | Church et al. | |
| 3,508,604 | A | 4/1970 | Foust | |
| 3,521,700 | A | 7/1970 | Knowles | |
| 3,595,475 | A | 7/1971 | Morton | |
| 3,612,164 | A | 10/1971 | Miner | |
| 3,623,543 | A | 11/1971 | Ostrander | |
| 3,635,245 | A * | 1/1972 | Canfield | F24F 3/00 137/601.05 |
| 3,820,713 | A | 6/1974 | Demaray | |

(Continued)

FOREIGN PATENT DOCUMENTS

| | | |
|---|---|---|
| EP | 908683 | 4/1999 |
| JP | 05180531 | 7/1993 |

(Continued)

*Primary Examiner* — Devon Russell

(74) *Attorney, Agent, or Firm* — Portland Intellectual Property, LLC

(57) ABSTRACT

An energy efficient HVAC system. The system provides a bypass air supply duct, an air handler having a bypass air supply circuit, and an air supply unit that utilize return air as a source of heat that would otherwise need to be provided by a heating coil if the air, cooled sufficiently to service interior zones of a building, is too cold for servicing perimeter zones of the building, as is typically the case when the outside air temperature is low.

12 Claims, 11 Drawing Sheets

(56) References Cited

U.S. PATENT DOCUMENTS 3,847,210 A * 11/1974 Wells ..... F24F 3/048 137/595
3,853,173 A * 12/1974 Osheroff ..... F15C 1/008 137/815
3,911,953 A * 10/1975 Crombie ..... F24F 11/027 137/595
3,994,335 A * 11/1976 Perkins ..... F24F 3/0522 137/601.05
4,008,756 A 2/1977 Hufford
4,019,566 A * 4/1977 Cobb ..... F24F 3/0444 165/216
4,164,976 A * 8/1979 Timmerman ..... F24F 13/04 137/601.08
4,531,573 A 7/1985 Clark et al.
4,795,088 A 1/1989 Kobayashi et al.
4,987,748 A 1/1991 Meckler
5,117,899 A * 6/1992 Skimehorn ..... F24F 3/052 165/119
5,461,877 A 10/1995 Shaw et al.
5,531,800 A 7/1996 Sewell et al.
5,931,227 A * 8/1999 Graves ..... F24F 3/0442 165/216
6,386,281 B1 5/2002 Ganesh et al.
6,604,688 B2 8/2003 Ganesh et al.
7,063,140 B1 * 6/2006 Woo ..... F24F 11/053 165/208
7,251,953 B2 8/2007 Wetzel et al.
7,726,582 B2 6/2010 Federspiel
8,141,374 B2 3/2012 Hay
8,326,464 B2 * 12/2012 Clanin ..... F24F 11/0001 454/228
2002/0125333 A1 9/2002 Ganesh et al.
2006/0117769 A1 6/2006 Helt et al.
2009/0236432 A1 9/2009 Malloy
2013/0096722 A1 4/2013 Clanin
2013/0320573 A1 12/2013 Fisher et al.
2014/0014291 A1 1/2014 Kraft
2015/0114596 A1 4/2015 Rohde

FOREIGN PATENT DOCUMENTS

JP 06042769 2/1994
JP 2006200847 8/2006

* cited by examiner

ENERGY EFFICIENT HVAC SYSTEM

RELATED APPLICATION

This is a continuation of U.S. Ser. No. 14/069,147, filed Oct. 31, 2013, which is incorporated by reference herein in its entirety.

FIELD OF INVENTION

The present invention relates to heating, ventilation, and air conditioning ("HVAC") systems, particularly those employed in office and other commercial buildings.

BACKGROUND

HVAC systems are used to maintain a desired temperature in enclosed spaces that are subject to heat inputs and heat loss. Heat inputs may be internally produced within an enclosed space as a result of human occupancy and activity, and the operation of heat-generating apparatus such as computers and lighting systems (hereinafter "people and heat-generating equipment"). Heat inputs may also be externally applied, from solar radiation and convective heat transfer from outside air. On the other hand, heat may be lost from one enclosed space to another, and through exterior walls and windows.

Often, buildings in which HVAC systems are used have multiple levels (commonly referred to as "storeys" or "floors"). In general, each level will have perimeter walls and windows, and a floor and ceiling separating it from the levels immediately above and below. It will simplify the discussion to focus on just one level, it being understood that other levels may be treated the same; and hereinafter, the word "floor" will be used to refer to a level.

The HVAC system typically strives to maintain a constant temperature $T_{DESIRED}$, typically about 70 degrees Fahrenheit, on a floor, year-round. To do this, the floor is typically divided into multiple "zones" of temperature control. There are two basic types of zones, namely, "interior" and "perimeter." Interior zones are spaces enclosed on all sides by one or more of the perimeter zones. The significance of this relationship is that, if the temperature is controlled to be the same in the interior and perimeter zones—which it typically will be—there can be no heat loss from an interior zone. Rather, interior zones will always experience heat gain so long as there are any heating inputs, meaning so long as there are either people or heat-generating equipment within the interior zones. This establishes a need, year-round, to provide a "cold air supply" to the floor at a temperature $T_{LOWER}$, typically, about 55 degrees F.

In the basic prior art HVAC system, the building is provided with a cold air supply duct, that runs from an "air handler" portion of the HVAC system to the floor. The air handler must be exposed to outside air. It often resides on the roof of the building, or in a vented mechanical room within the building, or it may be installed outside the building. The air handler supplies the cold air supply duct with air at the lower temperature $T_{LOWER}$ needed to cool all the interior zones. In turn, the cold air supply duct supplies cold air to both the perimeter and interior zones.

The building is also provided with a "return air" duct that ducts air from the floor to the air handler. So the return air duct completes a circuit, which is easiest to visualize in the case of interior zones, wherein relatively cold air (at the temperature $T_{LOWER}$) is supplied from the air handler to the cold air supply duct, from the cold air supply duct to the zones, warmed by people and equipment in the zones (to the temperature $T_{DESIRED}$), and returned to the air handler through the return air duct (at the temperature $T_{DESIRED}$).

The air is circulated by fans at the air handler. The rotational velocity of the fans are varied to match the airflow.

Within each zone, there are one or more "air supply units" that connect to the cold air supply duct, and controllably vary the amount of airflow from the cold air supply duct into the zone. Each air supply unit also includes means for heating the air received from the cold air supply duct, typically an electric or hot water coil (hereinafter, the term "heating coil" will refer generally to these and any other standard means of heating air). The air supply units vary the volume of the airflow and/or heat the air according to a need established by a temperature sensor and a feedback control system using $T_{DESIRED}$ as the set-point. Thus, while each zone may have any number of air supply units, the air-flow and heating requirements at all of the air supply units of the same zone will be the same, controlled by reference to the output of a single temperature sensor associated with that zone.

To supply the cold air supply duct, the air handler is capable of mixing outside air with return air in any proportion desired, and further cooling the air, if needed, by means of a refrigerating coil, or a coil carrying either refrigerated or unrefrigerated water (hereinafter, the term "cooling coil" will refer generally to these and any other standard means of cooling air), to achieve the temperature $T_{LOWER}$.

When the outside air temperature is HOT (substantially higher than the temperature $T_{DESIRED}$), the air handler will draw the minimum volume of outside air necessary for ventilation purposes, so a large percentage of the return air (at the temperature $T_{DESIRED}$) is recycled through the building.

Assuming that all the zones have substantially equal heating inputs from people and heat-generating equipment, the most cooling will be required in a perimeter zone because, in addition to the heat gain from people and heat-generating equipment as in interior zones, there is heat gain through the walls of the building in the perimeter zones under HOT conditions.

All the zones (perimeter and interior) will require cooled air under HOT conditions. But there will generally be one zone that requires the most cooling, establishing the cold air supply temperature $T_{LOWER}$, assuming maximum airflow into that zone.

At other zones where less cooling is needed, less cooling is provided by diminishing the flow of cold air through the air supply units at those zones.

On the other hand, when the outside air temperature is COLD (substantially lower than the temperature $T_{DESIRED}$), no cooling is needed to produce the cold air supply—it is sufficient for the air handler to mix cold outside air with return air to produce the cold air supply (at the temperature $T_{LOWER}$). There will be heat loss in the perimeter zones, so the air supply units in the perimeter zones must heat the cold air supply by use of the heating coil.

Between the extremes of HOT and COLD outside air temperatures, there are transitional temperature circumstances which can be defined according to whether (A) for all the perimeter zones, the heating inputs (from people and heat-generating equipment in the zone, and the influence of outside air temperature and solar radiation impacting external walls and transmitted through windows) exceeds the heat loss to the external environment (through external walls and windows), in which case no heating is required in any of the zones (hereinafter "temperature circumstance (A)), or (B)

there is at least one perimeter zone in which the heat loss exceeds the heat inputs, so that heating will be required at the air supply unit of any such perimeter zone, requiring use of the associated heating coil (hereinafter "temperature circumstance (B)).

As a further refinement, it was just noted previously that under HOT conditions, all the zones will require cooled air, though some will require less cooling than others; and at the zones where less cooling is needed, less cooling is provided by diminishing the flow of cold air through the air supply units at those zones. However, there is a minimum level of airflow that must be provided at each air supply unit to provide adequate ventilation for the zone. It may be that, even at this minimum level of airflow, too much cooling would occur in a particular zone. Since the airflow cannot be diminished any further, the air supply unit at that zone must apply the heating coil to heat the air (hereinafter "temperature circumstance (C)).

So, under temperature circumstances (B) or (C) the prior art HVAC system heats at least some of the air drawn from the cold air supply by use of one or more heating coils at air supply units serving the perimeter zones.

In a refinement of the basic system, a "hot air supply duct" is provided in the building, so there are now three ducts: (1) a cold air supply duct; (2) a hot air supply duct; and (3) a return air duct. And, in addition to a cooling coil for cooling outside/return air as needed to provide the cold air supply, the air handler has a heating coil for heating outside/return air as needed to provide the hot air supply.

The air supply units are adapted to draw from either the cold air supply duct, in zones requiring cooling, or the hot air supply duct, in zones requiring heating, and to match the cooling or heating needs by varying the level of airflow. However, again, there is a minimum airflow requirement at each of the air supply units, to provide for adequate ventilation. If some cooling is required but too much cooling would be produced at a particular zone at the minimum level of flow of air from the cold air supply, the air supply unit mixes air from the hot and cold air supplies to produce the required heating. Essentially, the heating that would have been provided by use of a heating coil at the air supply unit is provided, instead, by use of a heating coil in the air handler.

It is an object of the present invention to provide for more efficient HVAC systems.

SUMMARY

An energy efficient HVAC system is disclosed herein. A generic air handler for the system is provided for ventilating and cooling a building having a return air duct for returning air from the building to the air handler. The air handler has a cold air circuit including at least one cold air supply fan and one or more dampers for drawing first return air from the return air duct and outside air in a first, adjustable proportion to produce a desired outside/return air mixture, and for propelling the desired outside/return air mixture past a cooling coil adapted to provide for cooling or not cooling the outside/return air mixture as needed or desired to provide a cold air supply at a cold air temperature T1 to the building. The air handler also has a bypass air circuit including a bypass air supply fan and one or more dampers for drawing second return air from the return air duct and outside air in a second proportion that results in bypass air at a bypass air temperature T2, and for propelling the bypass air to the building as a bypass air supply in parallel with and separated from the cold air supply. During normal operation of the air handler, the cold air temperature T1 is at least 5 degrees lower than the bypass air temperature T2.

In a basic alternative embodiment, the generic air handler is employed in combination with at least one remotely located air supply unit. The air handler and the at least one air supply unit are in fluid communication through at least two additional ducts in the building, namely, a cold air supply duct and a bypass air supply duct. The air handler is adapted so that the cold air supply fan propels the outside/return air mixture to the cold air supply duct and the bypass air supply fan propels the second return air to the bypass air supply duct.

The at least one air supply unit may include one or more dampers adapted to provide for at least one of two modes of operation of the at least one air supply unit, namely, either (A) selecting an un-mixed air supply from the bypass air supply duct, or (B) mixing air from the bypass air supply duct with air from the cold air supply duct in an adjustable proportion as needed or desired to meet a heating or cooling requirement in the building.

In an enhanced embodiment, the at least one air supply unit may be in fluid communication with at least one additional duct in the building, namely, a hot air supply duct. The air handler is adapted so that the bypass air supply fan draws third return air from the return air duct and propels the third return air past a heater and thence to the at least one air supply unit through the hot air supply duct as a hot air supply at a hot air temperature T3, wherein, at the air handler during normal operation thereof, the hot air temperature T3 is at least 5 degrees higher than the bypass air temperature T2.

The at least one air supply unit of the enhanced embodiment may include one or more additional dampers adapted to provide for at least one of two modes of operation of the at least one air supply unit, namely, either (A) selecting an unmixed air supply from one of the cold, hot, and bypass air supply ducts and varying the airflow as needed or desired to meet a heating or cooling requirement in the building, or (B) mixing air from the bypass air supply duct with air from either the hot or cold air supply ducts in an adjustable proportion as needed or desired to meet the heating or cooling requirement.

In a multizone embodiment of the system, the building includes a plurality of zone air supply ducts for supplying air to respective zones of the building. The generic air handler is more particularly adapted so that the cold air supply fan propels the cold air supply to a cold air chamber in the air handler, and the bypass air supply fan propels the bypass air supply to at least one of two chambers in the air handler, namely a bypass air chamber and a hot air chamber, the hot air chamber including a heater for heating air propelled to the hot air chamber. The cold air chamber, bypass air chamber, and hot air chamber are in fluid communication with each of the zone air supply ducts via respective damper sets. Both the cold air supply fan and the bypass air supply fan are adapted to allow for controlling the rotational velocities thereof so that, as the rotational velocity of one of cold air supply fan and the bypass air supply fan is decreased, the rotational velocity of the other of the cold air supply fan and the bypass air supply fan is increased to maintain a substantially constant total airflow.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

DESCRIPTION OF PREFERRED EMBODIMENTS

Figure 1:
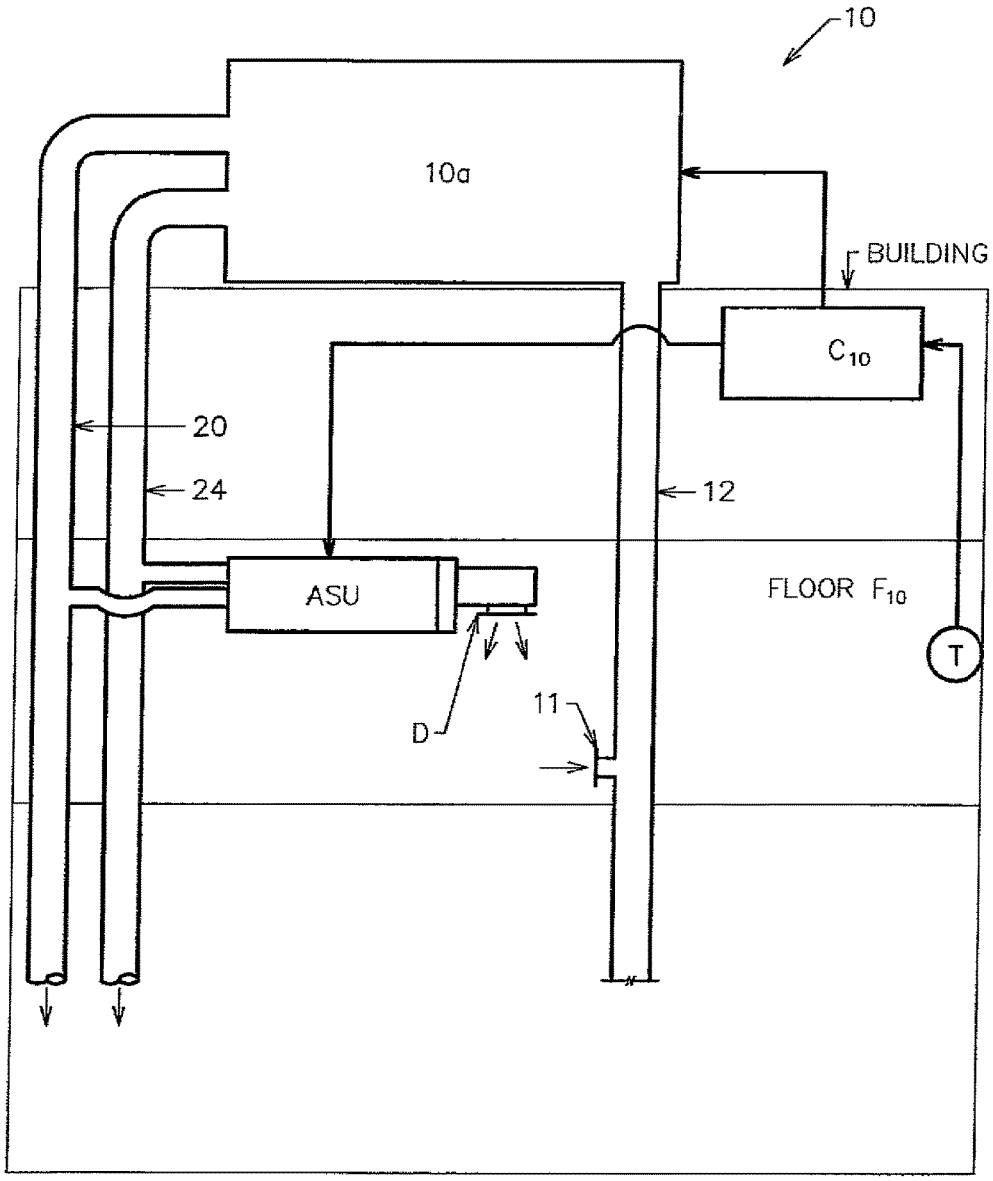
FIG. 1 is a block diagram of a basic HVAC system according to the present invention.

FIG. 1 provides an overview of a basic HVAC system 10 according to the present invention. The system is typically used for heating, ventilating, and air conditioning commercial buildings, such as office buildings, but could be used in any desired application.

Figure 2:
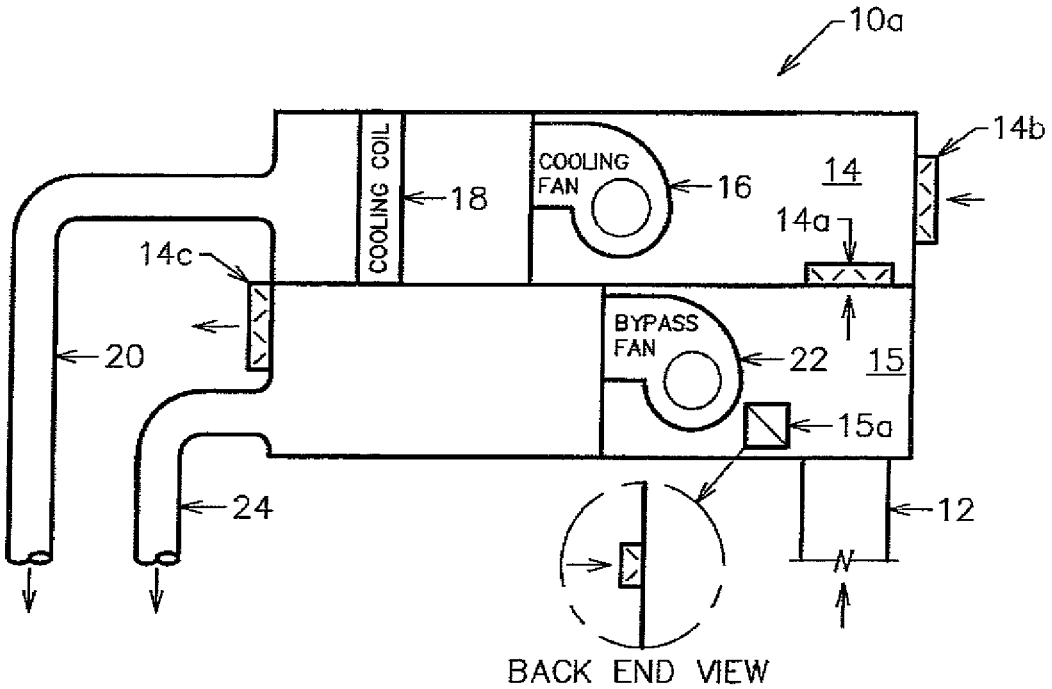
FIG. 2 is a schematic diagram of an air handler, shown in side elevation, of the system of FIG. 1 according to the present invention.

With additional reference to FIG. 2, the system 10 includes an air handler 10*a*, which would typically be installed on the roof of the building, but which could be installed at any location that is in fluid communication with outside air. The system 10 is used generally for heating, ventilating, and/or air conditioning a (substantially) enclosed space, which will hereinafter be referred to as a "building" for convenience but with no loss of generality being implied, and for purposes herein the term "outside air" will refer to air that is outside the building.

The air handler 10*a* is in fluid communication with three ducts that run within the building, a return air duct 12, a cold air supply duct 20, and a novel bypass air supply duct 24 that is part of a novel "bypass air" circuit according to the invention.

With particular reference to FIG. 2, the air handler 10*a* receives "return" air from the building through a return air duct 12. The air is returned from the building through inlet "grilles" 11 inside the building (see FIG. 1).

Some of the return air from the return air duct 12 is drawn into a cold air staging chamber 14 through a variable return air inlet damper 14*a* by negative pressure produced by a cooling fan 16. Outside air is also drawn into the cold air staging chamber 14 through a variable outside air inlet damper 14*b* by the same negative pressure. Respective position control of the return and outside air intake dampers provides for mixing the drawn return air and the drawn outside air in an adjustable proportion to produce an outside/return air mixture that the cooling fan 16 propels through, past, or across (hereinafter "past") a cooling coil 18 and into the cold air supply duct 20.

The air handler 10*a* also includes a "bypass air circuit" including a bypass air staging chamber 15 into which the return air is first drawn by negative pressure provided by a "bypass fan" 22. As noted above, some of this return air is drawn into the cold air staging chamber 14. The remaining return air, along with outside air that may be drawn through a bypass circuit outside air inlet toggling damper 15*a* (depending on whether the damper 15*a* is open or closed), is propelled by the bypass fan 22 into the bypass air supply duct 24. The damper 15*a* could be variable. Some of the air propelled by the fan 22 may be exhausted to the external environment through a variable exhaust damper 14*c*.

The outside/return air mixture in the cold air staging chamber 14 varies according to the temperature circumstances, and so does the amount of cooling provided at the cooling coil. There must always be some outside air intake to provide for adequate ventilation, which is set by maintaining a minimum position on the outside air damper 14*b*.

The exhaust damper 14*c* allows for exhausting an amount of return air equal to the quantity of outside air taken in, to maintain neutral air pressure in the building. The bypass circuit outside air inlet toggling damper 15*a* (which could alternatively be a variable damper) allows fresh air to enter the bypass air supply duct, to provide for adequate ventilation when only the bypass air supply duct (or the hot air supply duct discussed further below in connection with an enhanced HVAC system according to the invention) is utilized as described further below in connection with the toggling dampers of FIG. 5.

Figure 3:
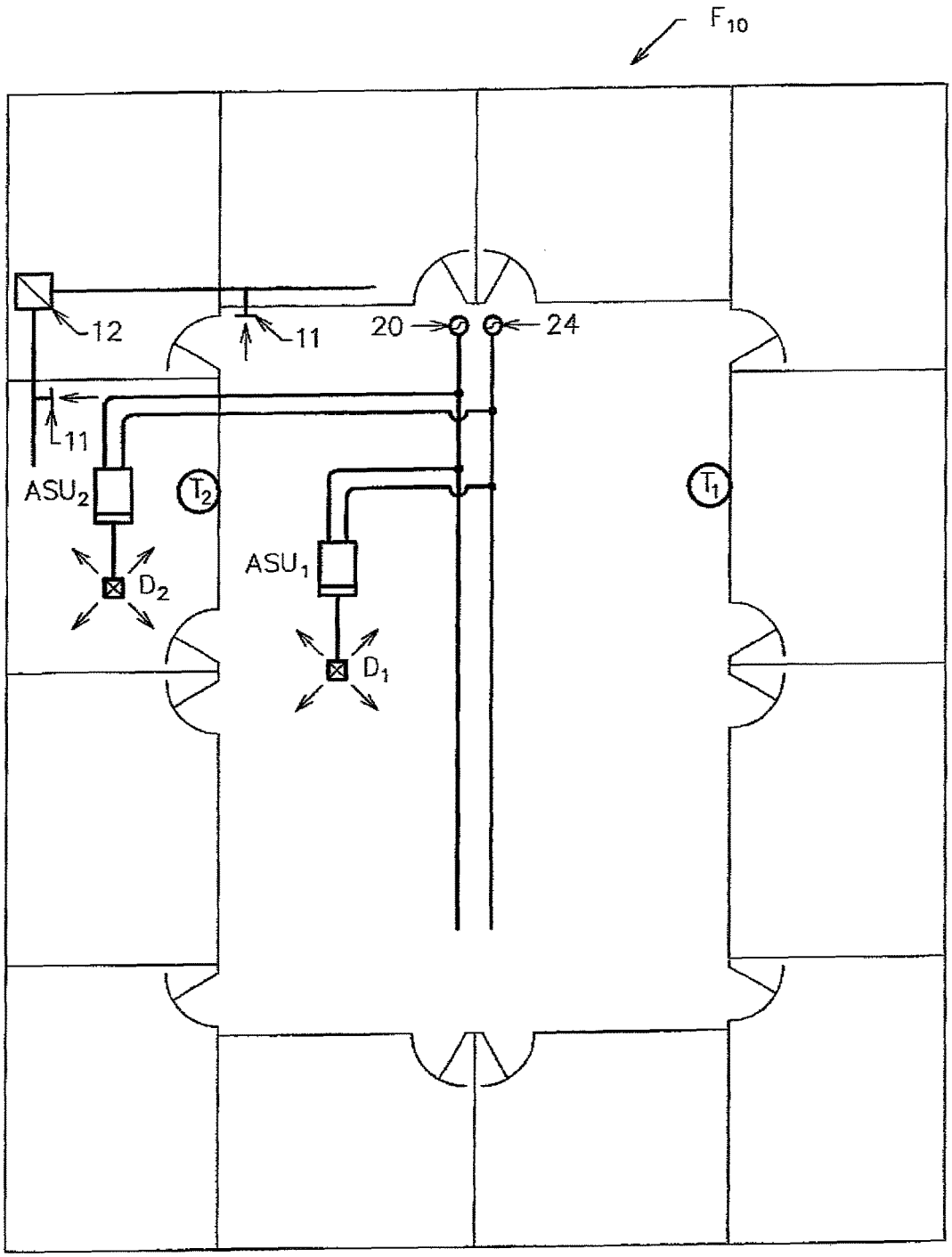
FIG. 3 is a schematic diagram of a representative floor of a building, shown in plan, served by the system of FIG. 1.

Referring to FIGS. 1 and 3, the two supply ducts, i.e., the cold air supply duct 20 and the bypass air supply duct 24, and the return air duct 12, typically run inside the building to each floor "F" of the building. There are typically multiple floors. But to simplify the discussion, it may be assumed that all the floors in the building are the same or, equivalently, that there is only one floor F, which is referenced specifically as "$F_{10}$" in FIGS. 1 and 3 to signal its association with the system 10. It is to be understood that there may be any number of floors, and that the floors need not be treated alike by the system 10.

Figure 4:
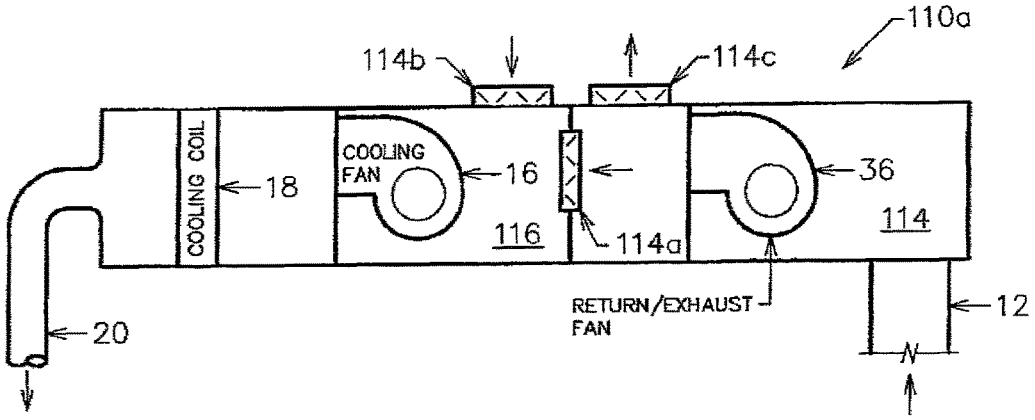
FIGURE 4 PRIOR ART
FIG. 4 is a schematic diagram of a typical prior art air handler, shown in side elevation, for comparison with the air handler of FIG. 2.

FIG. 4 shows a typical prior art air handler 110*a*, for comparison with the air handler 10*a* of FIG. 2. In the air handler 110*a* the return air is drawn into a first cold air staging chamber 114 under negative pressure produced by a "return/exhaust" fan 36. Some of the return air is allowed to exit the air handler to the external environment through a variable air valve, or "damper," namely exhaust damper 114*c*; and the remaining return air proceeds through a variable restriction damper 114*a* to a second cold air staging chamber 116 wherein, under negative pressure produced by a "cooling" fan 16, the remaining return air is mixed with outside air drawn through a variable outside air inlet damper 114*b*.

Respective position control of the exhaust, outside air inlet, and restriction dampers provides for mixing the remaining return air and the drawn outside air in an adjustable proportion to produce an outside/return air mixture that the fan 16 propels past a cooling coil 18 and into the cold air supply duct 20.

Again, the outside/return air mixture varies according to the temperature circumstances, and so does the amount of cooling provided at the cooling coil. There must always be some outside air intake to provide for adequate ventilation, which is set by maintaining a minimum position on the outside air damper 114*b*. The exhaust damper 114*c* allows for exhausting an amount of return air equal to the quantity of outside air taken in, to maintain neutral air pressure in the building.

A bypass air circuit according to the present invention including the bypass air supply chamber 15, the toggling damper 15*a*, and the bypass air fan 22 could be added to the air handler 110*a* in parallel with the existing circuit, in which case the function of the exhaust damper 14*c* would be provided by the existing exhaust damper 114*c*. The penalty relative to the air handler 10*a* is the need for an additional fan, namely, the return/exhaust fan 36.

Referring back to FIG. 3, the cold and bypass air supply ducts 20 and 24 feed what is typically a large number of "air supply units" ("ASU") at the floor of the building. To simplify the discussion, only two air supply units are shown for the floor $F_{10}$, namely "$ASU_1$," which in this example is an interior zone air supply unit, and "$ASU_2$," which in this example is a perimeter zone air supply unit, it being understood that there may be any number of interior and/or perimeter zone air supply units ASU, and that the construction of all the air supply units is preferably the same.

Figure 5:
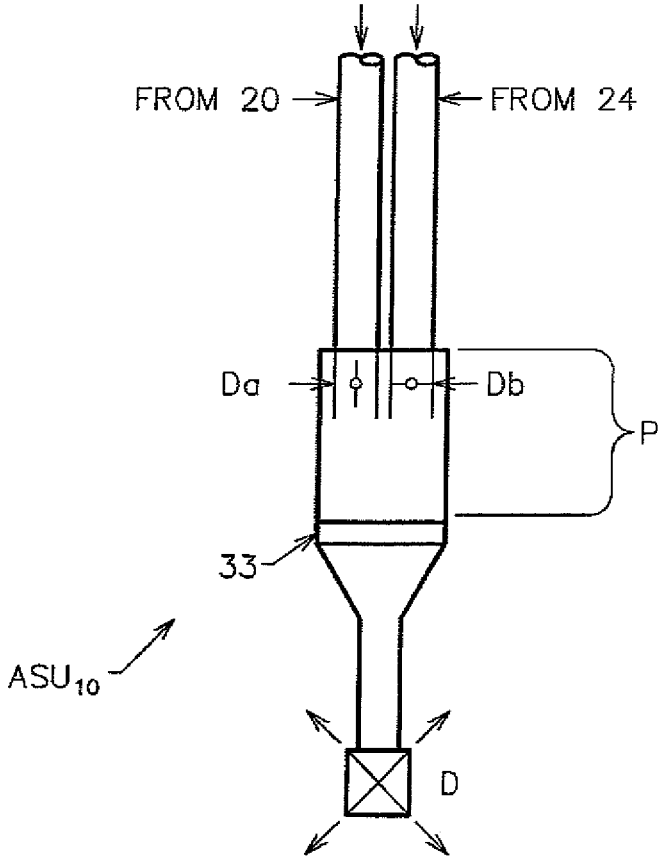
FIG. 5 is a schematic diagram of an air supply unit of the system of FIG. 1 associated with the floor of FIG. 3, according to the present invention.

FIG. 5 shows an air supply unit $ASU_{10}$ for use with the air handler 10. Air from the cold air supply duct 20 is allowed to enter the air supply unit through a cold air supply damper Da; and air from the bypass air supply duct 24 is allowed to enter the air supply unit through a bypass air supply damper Db. Position control of the cold and bypass air supply dampers Da and Db allows for selecting air from either the cold air supply duet, if cooling is needed, or the bypass air supply duct if heating is needed. The term "toggling mode" will refer to a mode of operation of a damper to de-select a duct, i.e., to shut off the airflow from that duct.

If cooling is needed and the bypass air supply duct is de-selected (or toggled "off"), the amount of airflow from the cold air supply damper Da is adjusted to match the zone requirement for cooling.

If heating is needed and the cold air supply duct is de-selected, heating may be provided by any known means, referred to generally as a "heater" and indicated as 33 in FIG. 5, which would typically be a heating coil as in the prior art. There is generally no need to limit the airflow through the bypass air supply duct, and greater airflow has the advantage of providing for greater ventilation. While greater airflow also increases the demand on the bypass air supply fan, much of the work done by the bypass air supply fan results in heating the air, reducing the need for heating by the heater.

There is a minimum airflow needed to provide for adequate ventilation. It may be that cooling is required, but not very much, and (with the bypass air supply duct de-selected) if air from the cold air supply duct is passed into the zone at the minimum airflow, too much cooling would result. To avoid this, the cold and bypass air supply dampers Da and Db are operated together in a "mixing mode" of operation. In the mixing mode of operation of the dampers Da and Db in the $ASU_{10}$, position control of the dampers provides for mixing air from the bypass air supply duct with air from the cold air supply duct in an adjustable proportion to produce a cold/bypass air mixture. While not allowing for the full range of control, just one mixing damper (e.g., the damper Db) could be used to provide for this mixing.

While it may generally be preferable, when cooling is required and the minimum ventilation requirement can be satisfied by varying the airflow from the cold air supply to duct to satisfy the cooling requirement, it may be a desirable alternative to always maintain a constant airflow through the air supply units, and operate the cold and bypass air supply dampers Da and Db in the mixing mode to regulate the temperature of the outlet air. The main advantage of the "constant airflow" strategy is that it provides for maximum ventilation, whereas the "variable airflow" strategy conforms to prior art practice and has the advantage of minimizing the power requirements of the fan.

In summary, when cooling is required in the air supply unit $ASU_{10}$, position control of the dampers Da and Db provides for either (A) de-selecting the bypass air supply duct (toggling damper Db "off") and thus providing an unmixed air supply from the cold air supply duct (through damper Da), and adjusting the airflow of the unmixed cold air supply as needed or desired to meet the zone cooling requirement (varying the airflow through damper Da), or (B) mixing air from the bypass air supply duct with air from the cold air supply duct (operating both dampers Da and Db in mixing mode) in an adjustable, desired proportion to provide a mixed air supply at the volume of airflow needed or desired to meet the zone cooling requirement.

Conversely, when heating is required in the air supply unit $ASU_{10}$, position control of the dampers Da and Db provides for de-selecting the cold air supply duct (toggling damper Da "off") and thus providing an unmixed bypass air supply from the bypass air supply duct at an airflow determined by control of the damper Db.

It is convenient that the portion of the air supply unit indicated as "P" is a standard, commercially available part, referred to as a "terminal unit."

Returning again to FIG. 3, the cold/bypass air mixture is further scattered into the spaces served by the air supply units by respective diffusers "D," here "$D_1$" and "$D_2$." There may be any number of the diffusers D in fluid communication with a given air supply unit.

As is standard practice, associated with each air supply unit $ASU_{10}$ is a temperature sensor "T," here "$T_1$" and "$T_2$." Each temperature sensor defines a zone within the space defined by the floor F. The temperature sensor is part of a temperature control circuit for the air supply unit, which measures the temperature in the zone, and which may or may not allow for an occupant of the zone to set the desired temperature in the zone. There may be any number of air supply units governed by the same temperature sensor, acting in concert.

One or more electrical or electronic control modules, referenced in FIG. 1 as controller "$C_{10}$," receive electrical signals from the temperature sensors, and produce electrical signals providing the aforementioned position control of the dampers at both the air handler units and the air supply units, which are suitably adapted for such electrical position control.

The rotational velocity of the cold air supply fan 16 is also controlled by the controller $C_{10}$ to maintain a designated pressure in the cold air supply duct 20, and the rotational velocity of the bypass air supply fan 22 is controlled to maintain a designated pressure in the bypass air supply duct 24. It will be appreciated by persons of ordinary skill that other strategies for controlling the fans could be employed.

The controller $C_{10}$ may include any number of programmable computers or computing modules, or hardwired electrical device or devices, localized or distributed. The structure and manner of operation of the temperature sensors and controller follows standard practice, applied according to the teachings herein.

The HVAC system 10 is more energy efficient—and under very cold conditions it is much more energy efficient—than the basic prior art HVAC system under the aforementioned transitional temperature circumstances (B) and (C). Under temperature circumstances (B) and (C), the prior art system expends energy for heating that is unnecessary in the system 10 because the system 10 utilizes heat energy already present in the return air (provided by people and heat-generating equipment). Specifically, whenever there is a zone that needs air at a temperature that is higher than $T_{LOWER}$, the prior art HVAC system requires an expenditure of energy to heat the air; whereas the system 10 doesn't need to use any energy to heat the air unless and until there is a zone that needs air at a temperature higher than that of the bypass air, which is typically within one or two degrees F. of $T_{DESIRED}$.

Accordingly, defining $T_{MAX}$ as being the required air temperature of a given quantity of air expelled at a given air supply unit (as called for the by the temperature sensor for the zone the air supply unit serves), the higher the temperature $T_{MAX}$ greater than $T_{LOWER}$ but less than or equal to $T_{BYPASS}$ (or $T_{DESIRED}$ plus or minus one or two degrees, depending on the amount of outside air mixed with the return air), the greater the efficiency provided by the system 10, which is to eliminate the need to heat the given quantity of air from $T_{LOWER}$ to $T_{MAX}$. The greatest efficiency is reached when $T_{MAX}$ equals or exceeds $T_{BYPASS}$ (or $T_{DESIRED}$ as modified by mixing outside air with return air), in which case the prior art HVAC system must raise the temperature of the given quantity of air the maximum amount relative to the system 10 ($T_{BYPASS}$–$T_{LOWER}$), before the system 10 begins to consume heating energy as well (to raise the temperature of the given quantity of air above $T_{BYPASS}$).

Figure 6:
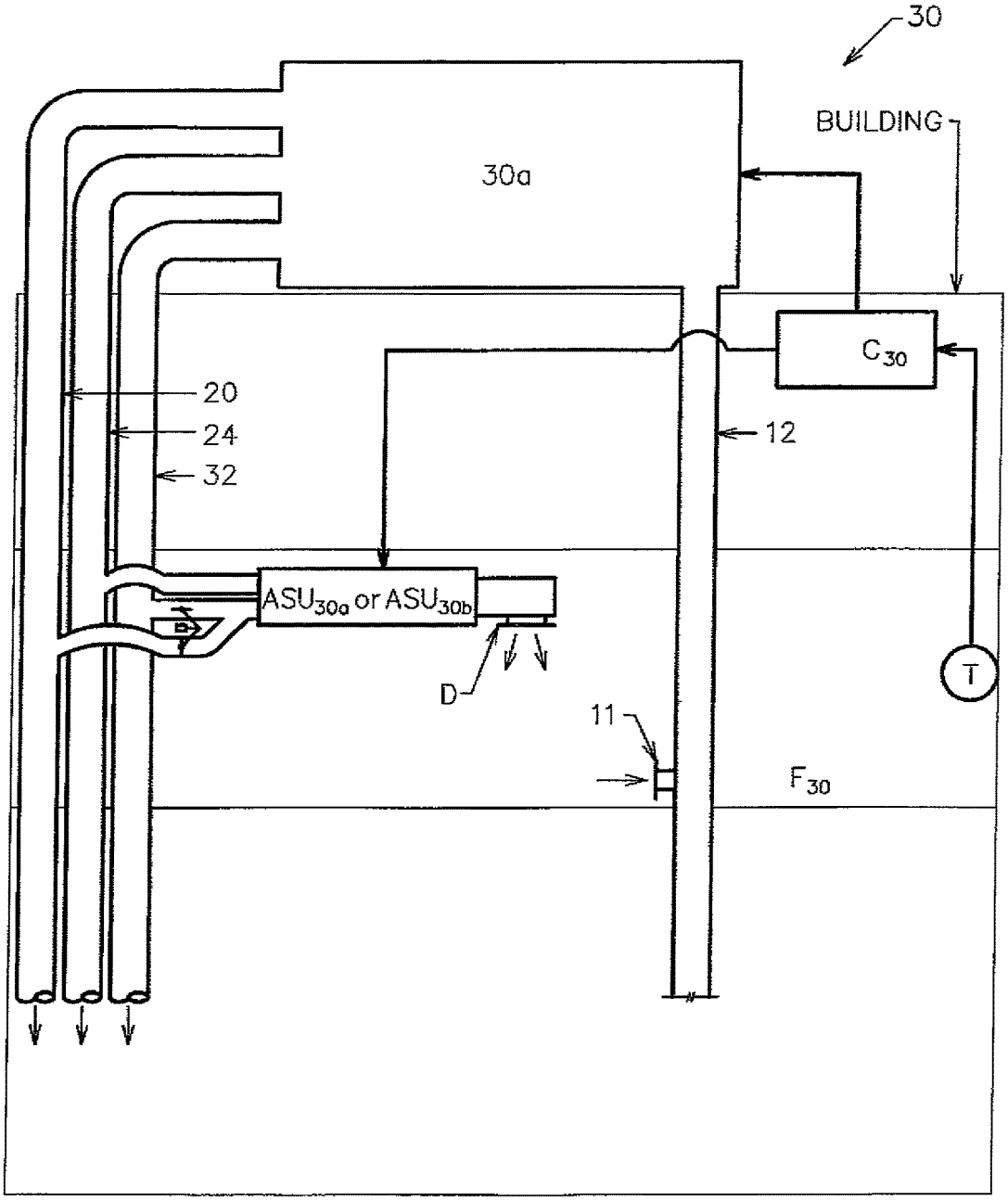
FIG. 6 is a block diagram of an enhanced HVAC system according to the present invention.

An enhanced HVAC system 30 according to the present invention is shown in FIG. 6. With additional reference to FIG. 7, the system 30 employs an air handler 30*a* having many of the same features as the air handler 10*a* of the basic system 10. The differences are that the air handler 30*a* has a heating coil 34 past which bypass air from the bypass air staging chamber 15 is propelled by the bypass air supply fan 22 and supplied to a hot air supply duct 32.

Figure 8:
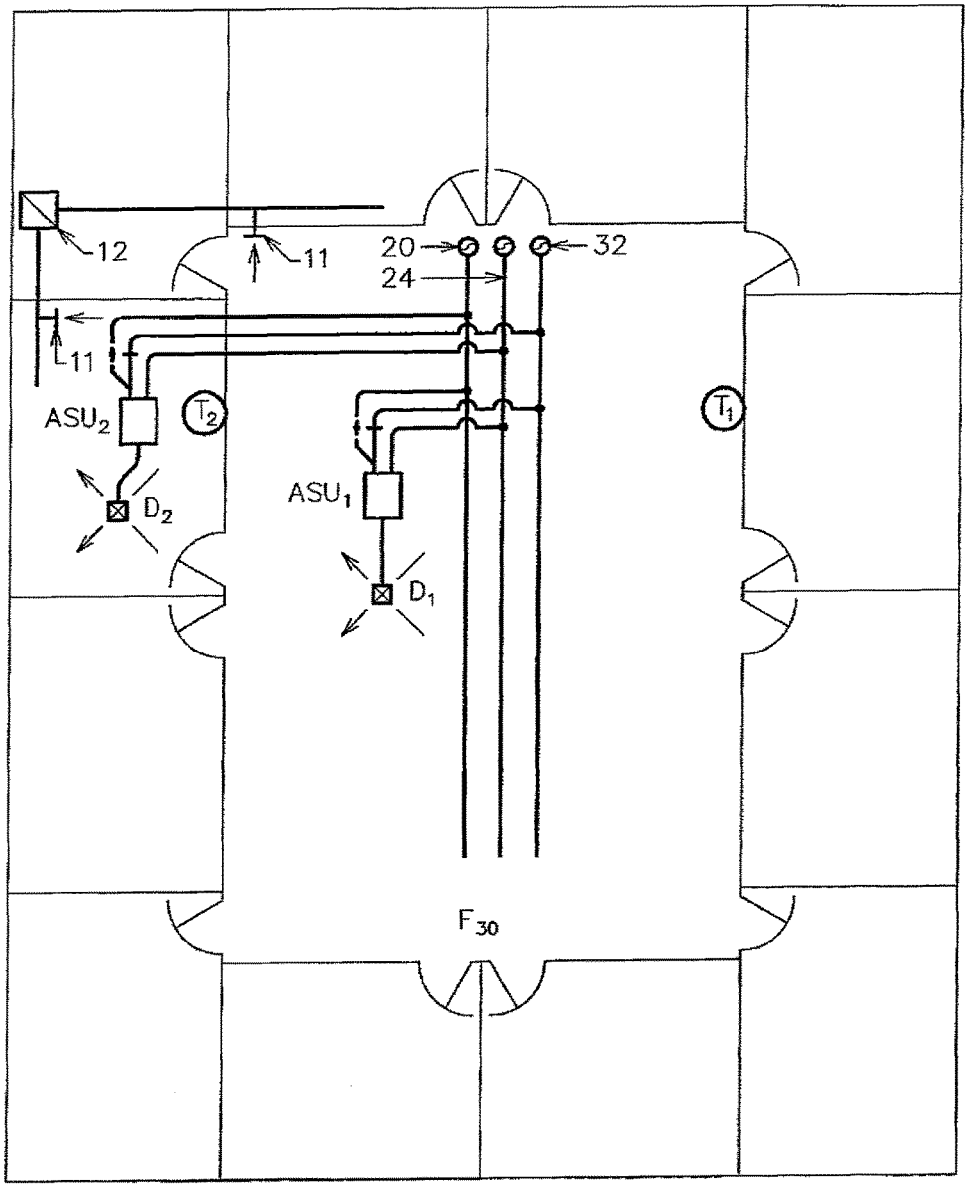
FIG. 8 is a schematic diagram of a representative floor of a building, shown in plan, served by the system of FIG. 6.

FIG. 8 shows the floor of FIG. 3 modified for use with the system 30, now referenced as "$F_{30}$." Again, it is to be understood that there may be any number of floors, and that the floors need not be treated alike by the system 30. There are now three supply duets running from the air handler 30*a* to the floor $F_{30}$, the cold air supply duct 20, the bypass air supply duct 24, and a hot air supply duct 32. These three ducts feed air supply units $ASU_{30a}$ or $ASU_{30b}$ as next described. As for the system 10, the air supply units have associated temperature sensors T, here again $T_1$ and $T_2$, defining two zones to which these air supply units belong, and air exiting the air supply units is further scattered into the spaces served thereby by respective diffusers D, here again $D_1$ and $D_2$.

Figure 9:
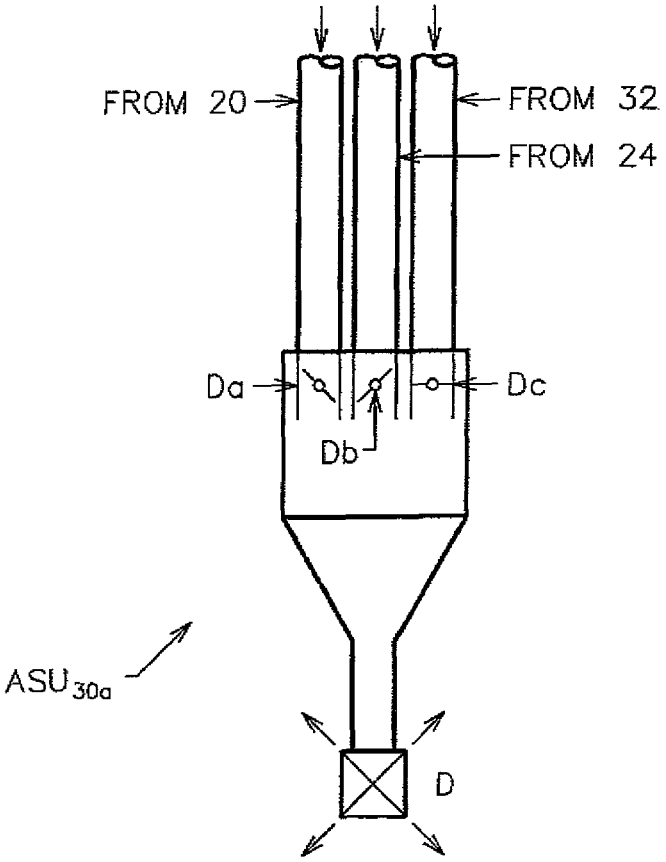
FIG. 9 is a schematic diagram of an air supply unit of the system of FIG. 6 and associated with the floor of FIG. 8, according to the present invention.

FIG. 9 shows an air supply unit $ASU_{30a}$ that could be used with the air handler unit 30. The air supply unit $ASU_{30a}$ is the same as the air supply unit $ASU_{10}$ (FIG. 5) except that it is adapted to receive air from the hot air supply duct 32 in addition to being adapted to receive air from the cold and bypass air supply ducts 20 and 24. As in the air supply unit $ASU_{10}$, the air supply unit $ASU_{30a}$ uses dampers (Da, Db, Dc) on each of the air supply ducts that may be operated in toggling, mixing, or variable airflow modes as needed or desired to satisfy the heating/cooling requirements at the zone.

Figure 10:
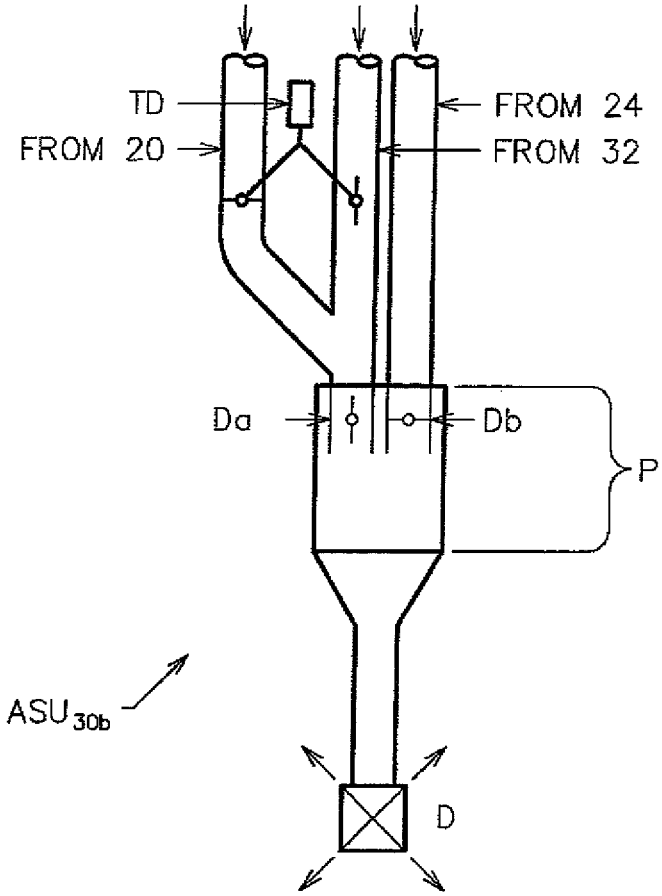
FIG. 10 is a schematic diagram of a preferred air supply unit of the system of FIG. 6 associated with the floor of FIG. 8, according to the present invention.

FIG. 10 shows a preferred air supply unit $ASU_{30b}$ having a portion "P" thereof that can be the standard "terminal unit" mentioned above. Here again, there are two dampers (Da, Db) that can be operated in either toggling, mixing, or variable airflow modes as needed or desired. The damper Db is used to control the flow from the bypass air duct 24. A toggling damper TD, not part of the standard terminal unit, is also provided for selecting air from either the cold air supply duct 20 or the hot air supply duct 32.

In the air supply unit $ASU_{30b}$, when cooling is required, the toggling damper TD closes off the flow of air from the hot air supply duct 32, passing air from the cold air supply duct 20 to the damper Da. Then, position control of the dampers Da and Db provides for either (A) de-selecting the bypass air supply duct (toggling damper Db "off") and thus providing an unmixed air supply from the cold air supply duct (through damper Da), and adjusting the airflow of the unmixed cold air supply as needed or desired to meet the zone cooling requirement (varying the airflow through damper Da), or (B) mixing air from the bypass air supply duct with air from the cold air supply duct (operating both dampers Da and Db in mixing mode) in an adjustable, desired proportion to provide a mixed air supply at the volume of airflow needed to meet the zone cooling requirement.

Conversely, when heating is required, the toggling damper TD closes off the flow of air from the cold air supply duct 20, passing air from the hot air supply duct 32 to the damper Da. Then, position control of the dampers Da and Db provides either for (A) de-selecting the bypass air supply duct (toggling damper Db "off") and thus providing an unmixed air supply from the hot air supply duct (through damper Da), and adjusting the airflow of the unmixed hot air supply as needed or desired to meet the zone heating requirement (varying the airflow through the damper Da), or (B) mixing air from the bypass air supply duct with air from the hot air supply duct (operating both dampers Da and Db in mixing mode) in an adjustable, desired proportion to provide a mixed air supply at the volume of airflow needed or desired to meet the zone heating requirement.

As for the system 10, it may generally be preferable to use the "variable airflow" strategy (A) when cooling is required and the minimum ventilation requirement can be satisfied, but it can be a desirable alternative to use the "constant airflow" strategy (B). Again, the main advantage of the "constant airflow" strategy is that it provides for maximum ventilation, whereas the "variable airflow" strategy conforms to prior art practice and has the advantage of minimizing the power requirements of the fan.

Also as for the HVAC system 10, in the HVAC system 30 one or more electrical or electronic control modules, referenced in FIG. 6 as "$C_{30}$," receive electrical signals from the temperature sensors, and produce electrical signals providing the aforementioned position control of the dampers at both the air handler and the air supply units, which are suitably adapted for such electrical position control.

The rotational velocity of the cold air supply fan in the system 30 is also controlled by the controller $C_{30}$ the same as in the system 10. The rotational velocity of the bypass air supply fan 22 in the system 30 is controlled to maintain a designated pressure in the hot air supply duct 32 and the bypass air supply duct 24. It will be appreciated by persons of ordinary skill that other strategies for controlling the fans could be employed.

Like the controller $C_{10}$, the controller $C_{30}$ may include any number of programmable computers or computing modules, or hardwired electrical device or devices, localized or distributed. The structure and manner of operation of the temperature sensors and controller follows standard practice, applied according to the teachings herein.

It may be noted that, in a variation of the system 30, there may be a separate parallel circuit, each with its own dedicated fan, for providing the bypass and hot air supplies.

As an extension of the aforementioned refinement to the basic prior art HVAC system described previously, having both hot and cold air ducts, some prior art HVAC systems provide separate air ducts for each zone. These are often referred to as "multizone" systems, though the distinction is not actually in the number of zones but rather in the number of ducts, particularly the number of ducts emanating from the air handler, at least one for each zone in the building. Each duct carries air at the desired temperature and flow rate to the zone, the temperature and flow rate being determined at the air handler, the flow rate being adjusted by use of dampers, and the temperature being adjusted by use of heating and cooling coils the same as in the refined basic system.

The principles employed in the system 30 can also be extended to a "multizone" embodiment, where the functions of selecting air from one of three bypass, cold, and hot air ducts according to the variable airflow strategy (A), or mixing air from the bypass duct with air from either the cold or hot air supply ducts according to the constant airflow strategy (B), which in the system occurs at the air supply units within the zone are performed at the air handler instead.

Figure 11:
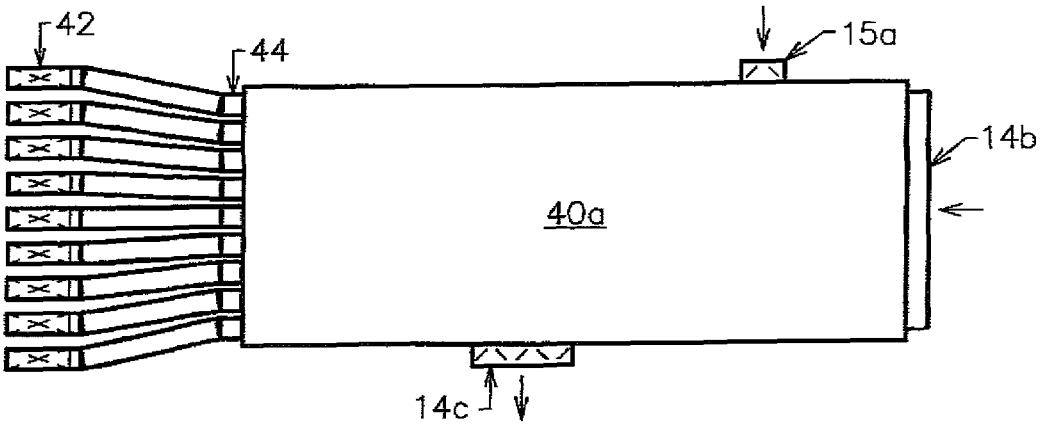
FIG. 11 is a schematic diagram of an air handler, shown in plan, for use in a multizone HVAC system according to the present invention.

More particularly with reference to FIG. 11 showing, in plan, an air handler 40*a* of a multizone HVAC system 40 according to the present invention, there are multiple zone air supply ducts 42 emanating from the air handler, each duct 42 supplying air to one particular zone in the building.

Figure 7:
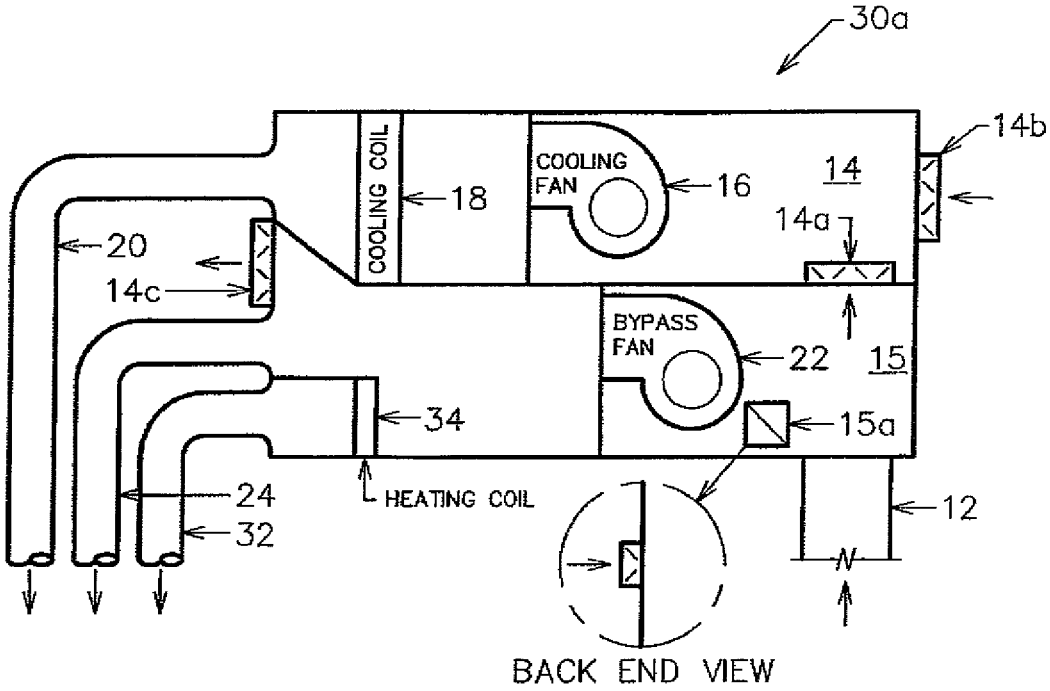
FIG. 7 is a schematic diagram of an air handler, shown in side elevation, of the system of FIG. 6, according to the present invention.
Figure 12:
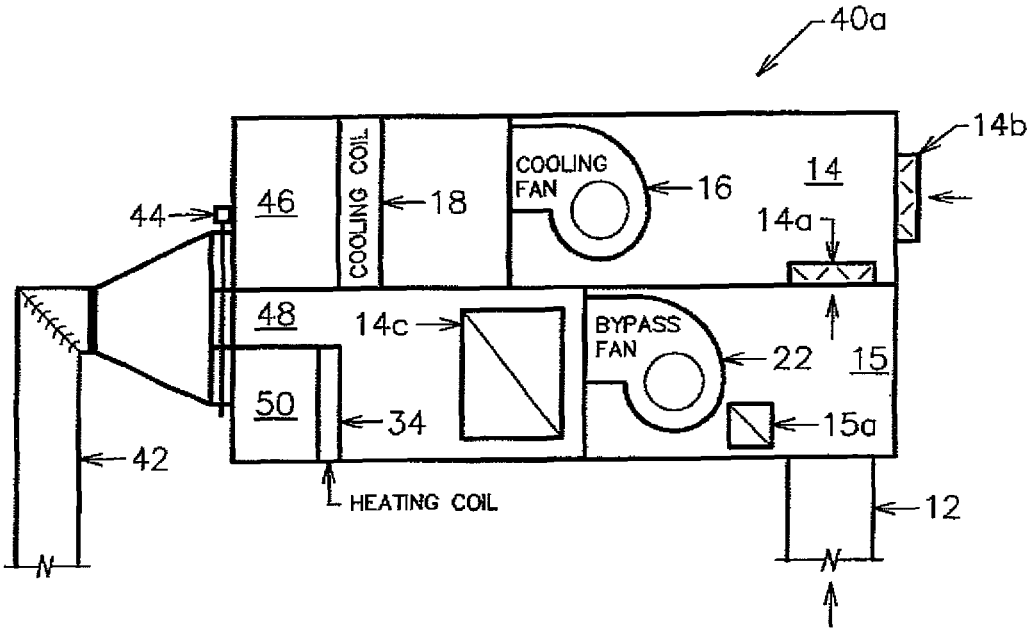
FIG. 12 is a schematic diagram of the air handler of FIG. 11 shown in side elevation.

FIG. 12 shows the air handler 40*a* in side elevation. Comparison of the air handler 40*a* as shown in FIG. 12 with the air handler 30*a* of the system 30 as shown in FIG. 7 reveals that the two are essentially the same, except that the air handler 40*a* includes, for each of the ducts shown in FIG. 11, a "damper set" 44 that may provide for the same selecting and mixing functions that were described above in connection with the system 30 as being performed at the air supply units.

More particularly, the functions of the cold, bypass, and hot air ducts in the system 30 are replaced by corresponding cold, bypass, and hot air chambers, referenced as 46, 48, and 50 respectively, in the air handler 40*a*. The damper set 44 associated with a given zone air supply duct 42 is adapted to provide for at least one of two modes of air supply to the zone air supply duct, either (A) selecting an unmixed air supply from one of the cold, hot, and bypass air chambers, or (B) mixing air from the bypass air chamber with air from either the hot or cold air chambers in an adjustable proportion to provide a mixed air supply.

The prior art multizone systems do not provide for varying the airflow. Likewise it is believed to be preferable to provide only for the "constant airflow" strategy (B) in multizone systems according to the present invention, so that the damper sets would not be adapted to vary the airflow according to strategy (A). This has the usual advantage of maximizing ventilation, but also allows for use of the same damper sets that are used in the prior art, accompanied by simpler control.

The cold, bypass and hot air chambers referred to in connection with the multizone system 40 correspond to the cold, bypass, and hot air supply ducts referred to in connection with the systems 10 and 30. The term "air supply" is used herein as a generic term to refer to either an air supply duct or an air chamber.

When using the "constant airflow" strategy (B), it remains desirable, in all HVAC systems according to the present invention, to provide for controlling the rotational velocities of the cold air supply fan and the bypass air supply fan. The rotational velocity of each supply fan is increased or decreased to match the airflow requirements for the corresponding supply. That is, during cool weather, as the outside air temperature decreases, the cooling load also decreases, so a reduced amount of cold air is required with a corresponding increase in the need for warm air. Conversely, during warm weather, as the outside air temperature increases, the cooling load increases, so an increased amount of cold air is required with a corresponding decrease in the need for warm air. Where there are separate fans providing the cold and warm air supplies, each needs to be controlled to vary its throughput to provide for a substantially constant total airflow.

When using the "variable airflow" strategy (A), the airflow is varied as needed or desired to meet a heating or cooling requirement, because varying the airflow under strategy (A) is not always needed; for example, where unmixed air is selected from the bypass supply. If heating is needed and bypass air is selected, it is preferable to vary the output of the heating coil than to vary the airflow to meet the heating requirement.

It will be understood that, in any HVAC system according to the invention, any number of fans could be used to perform the functions of the cold and bypass air supply fans as described herein; accordingly, the terms "cold air supply fan" and "bypass air supply fan" as used herein refer to any number of fans performing the described or recited functions.

It will be understood that HVAC systems according to the invention may be used for heating, ventilating, air conditioning, and cooling (where return air temperature is reduced by mixing in outside air), alone or in any combination.

It will also be understood that, while the cold and bypass air circuits of HVAC systems according to the invention are shown one on top of the other at the air handler in the Figures, this particular mounting relationship or configuration is not essential, and any mounting relationship or configuration may be employed that provides for the indicated fluid flow paths.

For purposes herein, for any two points A and B served by a HVAC system according to the invention, point B is defined to be "downstream" of point A, and therefore point A is defined to be "upstream" of point B, if the pressure of the air supplied by the system is higher at point A than at point B.

All of the cold, bypass, and hot air supplies described herein are intended to be provided at distinctly different temperatures. Preferably, the temperature of the air of the cold air supply is at least 5 degrees lower than that of the air of the bypass air supply, and the temperature of the air of the hot air supply (if provided) is at least 5 degrees higher, when the air handler is operating normally, or during what is referred to in the art as "occupied hours of operation."

While specific HVAC methods and systems have been shown and described as preferred, other configurations and methods could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. An air handler for ventilating and cooling a building having a return air duct for returning air from the building to the air handler, the air handler comprising a cold air circuit including at least one cold air supply fan and one or more dampers for drawing first return air from the return air duct and first outside air in a first, adjustable proportion to produce a first outside/return air mixture, and for propelling the first outside/return air mixture past a cooling coil adapted to provide for cooling or not cooling the first outside/return air mixture as needed or desired to provide a cold air supply of cold air at a cold air temperature T1 to the building, and a bypass air circuit including a bypass air supply fan and one or more dampers for drawing second return air from the return air duct and second outside air in a second proportion to produce a second outside/return air mixture, resulting in bypass air at a bypass air temperature T2, and for propelling the bypass air to the building as a bypass air supply in parallel with and separated from the cold air supply, wherein the air handler is configured to provide for selecting said second proportion as needed or desired for use in the bypass air supply, wherein the bypass air circuit includes an exhaust damper for exhausting bypass air propelled by the bypass air supply fan as needed to maintain neutral air pressure in the building.

2. The air handler of claim 1 in combination with at least one remotely located air supply unit, the air handler and air supply unit being in fluid communication through at least two additional ducts in the building, a cold air supply duct and a bypass air supply duct, the air handler adapted so that the cold air supply fan propels the first outside/return air mixture to the cold air supply duct and the bypass air supply fan propels the second outside/return air mixture to the bypass air supply duct, wherein the at least one air supply unit includes one or more variably adjustable air supply dampers for controlling the amounts of air allowed to flow through the at least one air supply unit from the bypass and cold air supply ducts so as to provide for mixing air from the bypass air supply duct with the cold air supply duct in an adjustable proportion as needed or desired to meet a heating or cooling requirement in the building.

3. The air handler and combination of claim 2, in further combination with a heater located downstream of the one or more air supply dampers and upstream of the return air duct for heating the air allowed to flow through the at least one air supply unit from the bypass air supply duct.

4. The air handler and combination of claim 3, in still further combination with a controller adapted for controlling the cold air supply fan in response to changes in the amount of airflow in the cold air supply duct so as to maintain substantially constant pressure in the cold air supply duct.

5. The air handler and combination of claim 3, in still further combination with a controller adapted for controlling the bypass air supply fan in response to changes in the amount of airflow in the bypass air supply duct so as to maintain substantially constant pressure in the bypass air supply duct.

6. The air handler and combinations of claim 5, wherein the controller is further adapted for controlling the cold air supply fan in response to changes in the amount of airflow in the cold air supply duct so as to maintain substantially constant pressure in the cold air supply duct.

7. The air handler and combination of claim 2, in further combination with a controller adapted for controlling the cold air supply fan in response to changes in the amount of airflow in the cold air supply duct so as to maintain substantially constant pressure in the cold air supply duct.

8. The air handler and combination of claim 3, in further combination with a controller adapted for controlling the bypass air supply fan in response to changes in the amount of airflow in the bypass air supply duct so as to maintain substantially constant pressure in the bypass air supply duct.

9. The air handler and combinations of claim 8, wherein the controller is further adapted for controlling the cold air supply fan in response to changes in the amount of airflow in the cold air supply duct so as to maintain substantially constant pressure in the cold air supply duct.

10. The air handler of claim 1, in combination with a controller adapted for controlling the cold air supply fan in response to changes in the amount of airflow in the cold air supply duct so as to maintain substantially constant pressure in the cold air supply duct.

11. The air handler of claim 1, in combination with a controller adapted for controlling the bypass air supply fan in response to changes in the amount of airflow in the bypass air supply duct so as to maintain substantially constant pressure in the bypass air supply duct.

12. The air handler and combination of claim 11, wherein the controller is further adapted for controlling the cold air supply fan in response to changes in the amount of airflow in the cold air supply duct so as to maintain substantially constant pressure in the cold air supply duct.

* * * * *